US007448441B2

(12) United States Patent
Hendricks et al.

(10) Patent No.: US 7,448,441 B2
(45) Date of Patent: Nov. 11, 2008

(54) CARBON NANOTUBE HEAT-EXCHANGE SYSTEMS

(75) Inventors: Terry Joseph Hendricks, Arvada, CO (US); Michael J. Heben, Denver, CO (US)

(73) Assignee: Alliance for Sustainable Energy, LLC, Golden, CO (US)

( * ) Notice: Subject to any disclaimer, the term of this patent is extended or adjusted under 35 U.S.C. 154(b) by 449 days.

(21) Appl. No.: 10/492,483

(22) PCT Filed: Sep. 17, 2002

(86) PCT No.: PCT/US02/30370

§ 371 (c)(1),
(2), (4) Date: Apr. 8, 2004

(87) PCT Pub. No.: WO2004/027336

PCT Pub. Date: Apr. 1, 2004

(65) Prior Publication Data

US 2004/0194944 A1 Oct. 7, 2004

(51) Int. Cl.
*F28F 1/20* (2006.01)

(52) U.S. Cl. ..... 165/181; 165/905; 429/34

(58) Field of Classification Search ..... 165/181, 165/905, 907, 80.1, 80.2, 80.3, 80.4, 80.5, 165/104.33; 429/34; 422/130; 977/742, 977/762, 843, 845, 900
See application file for complete search history.

(56) References Cited

U.S. PATENT DOCUMENTS 5,901,037 A * 5/1999 Hamilton et al. ..... 165/104.33
5,985,112 A 11/1999 Fischer
5,997,832 A 12/1999 Lieber et al.
6,019,656 A 2/2000 Park et al.
6,190,634 B1 2/2001 Lieber et al.
6,256,996 B1 * 7/2001 Ghoshal ..... 977/742
6,280,677 B1 8/2001 Yakobson
6,282,907 B1 9/2001 Ghoshal
6,407,922 B1 6/2002 Eckblad et al.
6,589,682 B1 * 7/2003 Fleckner et al. ..... 429/34
6,749,814 B1 * 6/2004 Bergh et al. ..... 422/130
6,824,689 B2 * 11/2004 Wang et al. ..... 977/742
6,870,308 B2 * 3/2005 Heo et al. ..... 977/932
6,887,450 B2 * 5/2005 Chen et al. ..... 977/845

(Continued)

OTHER PUBLICATIONS

Chen, Gang, "Particularities of heat conduction in nanostructures," Journal of Nanoparticle Research 2: 199-204, 2000, the Netherlands.

*Primary Examiner*—Ljiljana (Lil) V Ciric
(74) *Attorney, Agent, or Firm*—Paul J. White

(57) ABSTRACT

A carbon nanotube heat-exchange system (10) and method for producing the same. One embodiment of the carbon nanotube heat-exchange system (10) comprises a microchannel structure (24) having an inlet end (30) and an outlet end (32), the inlet end (30) providing a cooling fluid into the microchannel structure (24) and the outlet end (32) discharging the cooling fluid from the microchannel structure (24). At least one flow path (28) is defined in the microchannel structure (24), fluidically connecting the inlet end (30) to the outlet end (32) of the microchannel structure (24). A carbon nanotube structure (26) is provided in thermal contact with the microchannel structure (24), the carbon nanotube structure (26) receiving heat from the cooling fluid in the microchannel structure (24) and dissipating the heat into an external medium (19).

23 Claims, 6 Drawing Sheets

U.S. PATENT DOCUMENTS 7,011,760 B2 * 3/2006 Wang et al. ..... 977/843
7,129,554 B2 * 10/2006 Lieber et al. ..... 977/762
7,211,464 B2 * 5/2007 Lieber et al. ..... 977/762
2002/0176804 A1 11/2002 Strand et al.

* cited by examiner

CARBON NANOTUBE HEAT-EXCHANGE SYSTEMS

CONTRACTUAL ORIGIN OF THE INVENTION

The United States Government has rights in this invention under Contract No. DE-AC36-99GO10337 between the U.S. Department of Energy and the National Renewable Energy Laboratory, a division of Midwest Research Institute.

TECHNICAL FIELD

This invention relates to heat-exchange systems and more specifically to carbon nanotube heat-exchange systems.

BACKGROUND ART

Most power-generation systems produce heat as a by-product. For example, internal combustion engines used to power most vehicles today combust a high-energy fuel (e.g., gasoline) to generate mechanical motion and heat. Fuel cells that convert hydrogen and oxygen into electricity and heat are also being developed for a variety of applications, including power production for vehicles and electrical appliances. Other power-generation systems, such as bio-fuel processing, petroleum refining, industrial processing, and solar-thermal systems, to name a few, also produce heat as a by-product. At least some of the heat produced by such power-generation systems must be dissipated to the ambient environment.

Various cooling systems have been developed for dissipating heat. Automobiles, for example, may have as many as fourteen separate cooling systems, including cooling systems for the engine, oil, air conditioning system, and transmission. By way of illustration, most internal combustion engines are cooled by a liquid (e.g., water, antifreeze) that is circulated through a cooling loop provided in thermal contact with the engine. As the liquid is circulated, it absorbs heat generated by the fuel combustion. The cooling loop is connected to a heat-exchange system (e.g., a radiator). One type of automobile radiator may have a tube arranged in a parallel or serpentine manner among a series of copper or aluminum "fins" that are provided in thermal contact with the surrounding air. As liquid from the cooling loop flows through the tube, heat is conducted from the liquid into the air flowing past the fins (e.g., as the automobile moves).

The specific design and performance of currently available heat-exchange systems is dominated by the heat transfer characteristics of the materials from which these systems are made and convective heat transfer conditions on the fin surfaces. For example, typical automobile radiators may be fabricated from metals which have a relatively high thermal conductivity (e.g., aluminum, copper, etc.). However, these materials make the heat-exchange systems heavy, which negatively impacts the automobile's performance, fuel consumption, and emissions. Recent studies have shown that every twenty pounds-mass (lbm) of weight in current light-duty automobiles increases fuel use by 0.1 miles per gallon (mpg). In addition, typical heat-exchange systems have relatively high air intake or air loading requirements so that the liquid can be effectively cooled by the air flow. These loading requirements increase the surface area that must be exposed to the air flow, making the heat-exchange system large and cumbersome. Indeed, radiators are typically positioned at the front of the vehicle to maximize air flow to the radiator. Consequently, these loading requirements also increase drag on the automobile, negatively impacting the automobile's performance, fuel consumption, and emissions.

Other materials have also been studied for use with heat-exchange systems. For example, carbon foams and porous ceramics (e.g., silicon carbide) are highly conductive. Although these materials are light-weight and exhibit relatively high thermal-exchange properties, these materials are structurally weak. Therefore, widespread use of these materials in heat-exchange systems is unlikely, especially in heat-exchange systems used on-board automobiles.

Consequently, a need remains for a high performance heat-exchange system that is structurally sound and light-weight. Additional advantages would be realized if the surface area and/or frontal loading of the heat-exchange system were reduced. Fuel cell systems may also be improved if the heat-exchange system can be used to cool one or more components of the fuel cell directly.

DISCLOSURE OF INVENTION

Carbon nanotube heat-exchange system may comprise a microchannel structure having an inlet end and an outlet end, the inlet end providing a cooling fluid into the microchannel structure and the outlet end discharging the cooling fluid from the microchannel structure. At least one flow path may be defined in the microchannel structure, fluidically connecting the inlet end to the outlet end of the microchannel structure. A carbon nanotube structure may also be provided in thermal contact with the microchannel structure, the carbon nanotube structure receiving heat from the cooling fluid in the microchannel structure and dissipating the heat into an external medium.

A method for producing a carbon nanotube heat-exchange system may comprise the steps of fabricating a microchannel structure for receiving a cooling fluid, fabricating a carbon nanotube structure, and arranging the microchannel structure in thermal contact with the carbon nanotube structure.

BRIEF DESCRIPTION OF THE DRAWINGS

Illustrative and presently preferred embodiments of the invention are shown in the accompanying drawings in which.

BEST MODES FOR CARRYING OUT THE INVENTION

Figure 1:
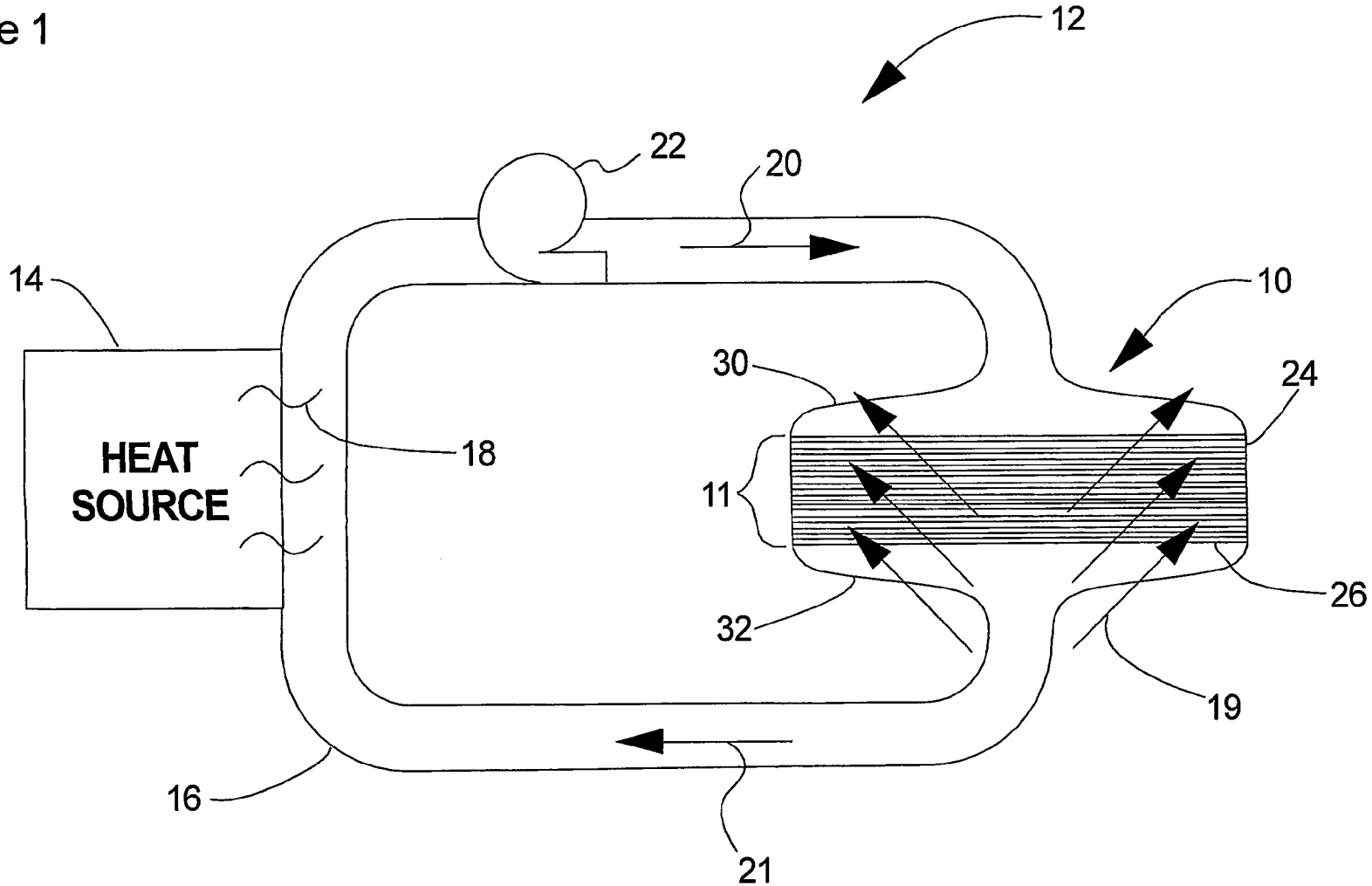
FIG. 1 is a high-level diagram illustrating a cooling system in which a heat-exchange system may be used according to one embodiment of the invention.

Carbon nanotube heat-exchange system 10 (FIG. 1) and method for producing the same is shown and described as it may be used in a cooling system 12 according to preferred embodiments of the invention. Briefly, heat-exchange systems 10 dissipate heat produced at a heat source 14 (e.g., an internal combustion engine). A cooling fluid may be circulated through a coolant loop 16 in and/or around the heat source 14 so that the fluid absorbs heat from the heat source 14. The heat-exchange system 10 is provided in thermal contact with the fluid circulating through the coolant loop 16 and with an external medium 19 (e.g., air). As the cooling fluid flows through the heat-exchange system 10, heat is transferred from the cooling fluid to the external medium. The cooling fluid may then be recirculated through the cooling loop 16 or discharged to the environment. Alternatively, the heat-exchange system 10 of the present invention may be provided in direct contact with the heat source 14, particularly where the heat source 14 is a relatively low-temperature heat source. The particular design of the heat-exchange system 10 can impact the efficiency of the power-generation systems, particularly when used in vehicles. Therefore, it is desirable to produce a structurally sound, high performance heat-exchange system.

A carbon nanotube heat-exchange system 10 (FIG. 2) may be produced according to one embodiment of the invention as follows. A microchannel structure 24 may be fabricated having a flow path 28 defined therein which fluidically connects an inlet end 30 (e.g., an intake manifold) to an outlet end 32 (e.g., a discharge manifold). In one embodiment, the microchannel structure 24 may be extruded from metal, although other embodiments are also described herein. A carbon nanotube structure 26 is also fabricated from carbon nanotubes. For example, the carbon nanotube structure 26 may be fabricated from single-walled carbon nanotubes (SWNTs) 15 (FIG. 2) blended with a polymer to form a SWNT-polymer composite. In any event, the carbon nanotube structure 26 is arranged in thermal contact with the microchannel structure 24 in such a manner so as to dissipate heat to a flowing medium (e.g., gas, air, or liquid) surrounding the SWNT-polymer composite structure.

Figure 2:
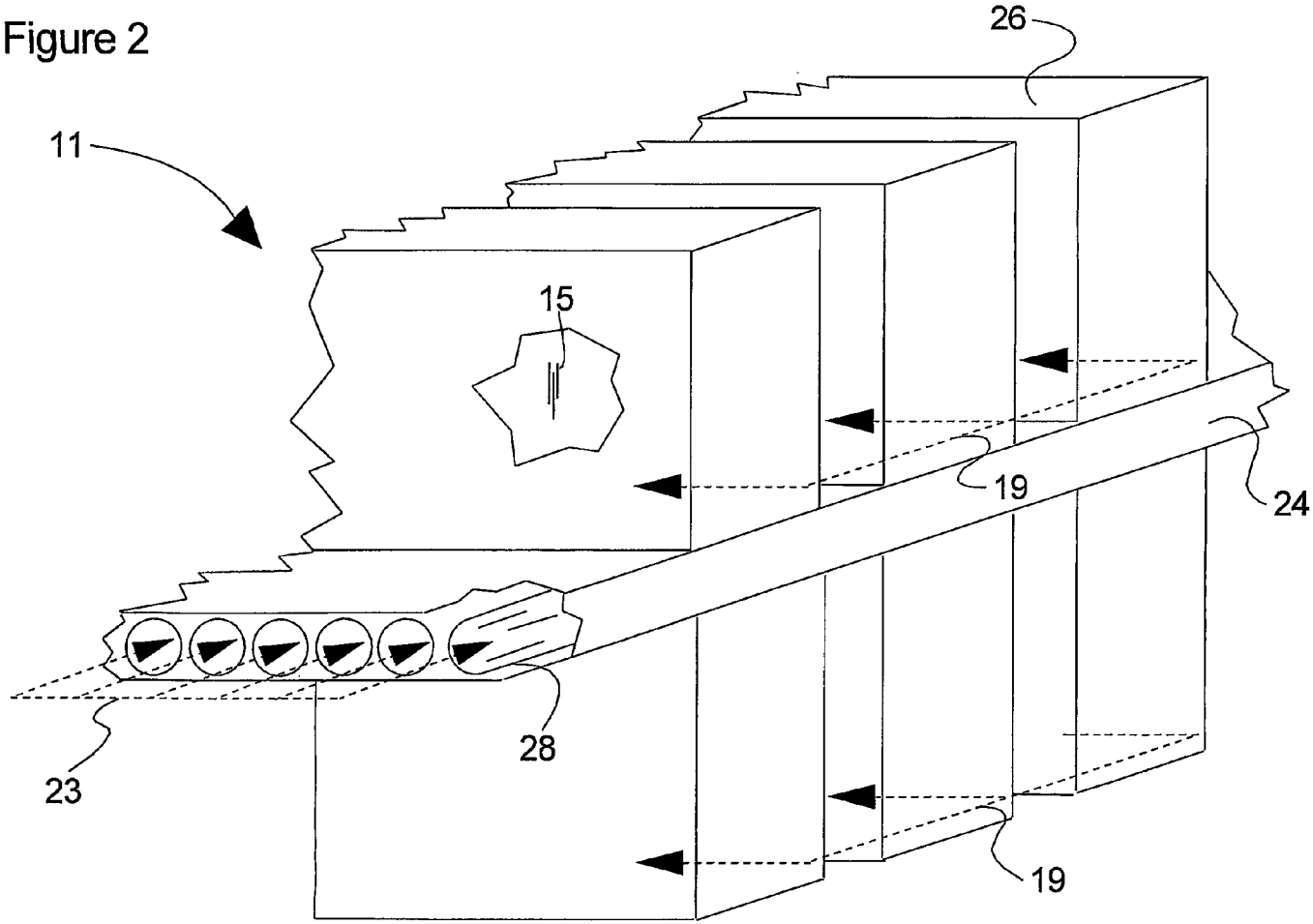
FIG. 2 shows a detailed section of one embodiment of the heat-exchange system wherein the carbon nanotubes are embedded in a polymer binder.
Figure 3A:
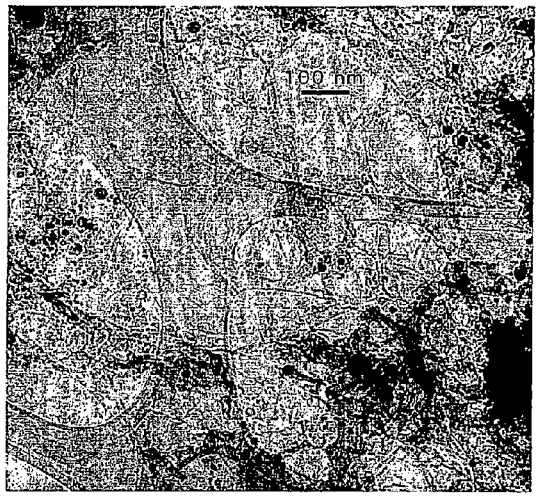
FIGS. 3(*a*) through 3(*d*) are transmission electron microscopy (TEM) images of carbon nanotube material that may be used to produce the heat-exchange system according to one embodiment of the invention.
Figure 3B:
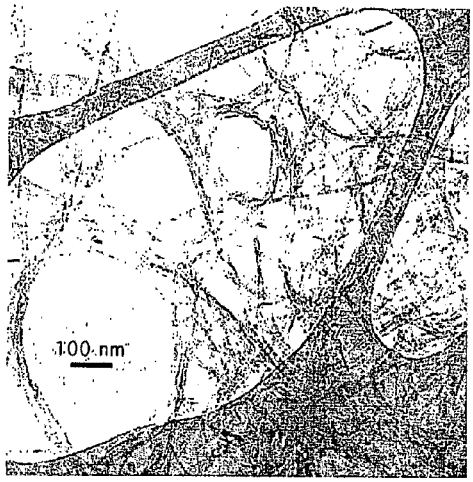
Figure 3C:
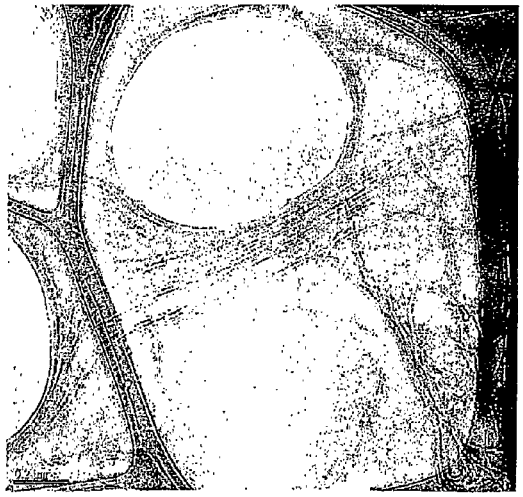
Figure 3D:
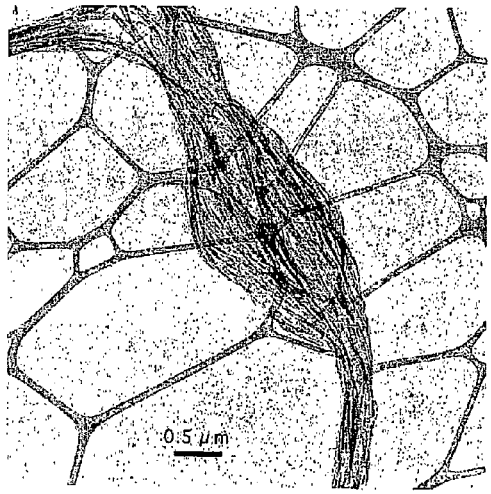

A carbon nanotube heat-exchange system 10 is shown in FIG. 2 according to one embodiment of the invention comprising microchannel structure 24 and carbon nanotube structure 26. At least one flow path 28 fluidically connects an inlet end 30 of the microchannel structure 24 to an outlet end 32 of the microchannel structure 24. Carbon nanotube structure 26 is arranged in thermal contact with the flow path 28 of microchannel structure 24 and is also provided in thermal contact with an external medium, as illustrated by arrows 19.

In use, cooling fluid circulates through the coolant loop 16 of the cooling system 12 as illustrated by arrows 20, 21. The cooling fluid is introduced into the inlet end 30 of the microchannel structure 24 and flows through flow path 28 before being discharged from the heat-exchange system on outlet end 32. Heat is transferred from the cooling fluid flowing through the microchannel structure 24 to the carbon nanotube structure 26, which in turn transfers the heat to the external medium (e.g., air) surrounding the carbon nanotube structure 26. The cooling fluid may then be recirculated through the coolant loop 16 to absorb more heat from the heat source 14. In other embodiments, the cooling fluid may be otherwise collected or released from the cooling system 12 (e.g., into the environment).

A significant advantage of the invention is the efficiency of the heat-exchange system 10. The relatively small flow paths 28 defined in the microchannel structure 26 provide a thin thermal boundary layer for highly-efficient two-phase or liquid-phase heat transfer. As such, the microchannel structure 24 provides efficient heat transfer from the cooling fluid to the carbon nanotube structure 26. In addition, carbon nanotubes have demonstrated high directional or anisotropic thermal conductivity (e.g., in the range of about 3000 to 6000 Watts/meter-Kelvin (W/m-K)). As such, the carbon nanotube structure 26 provides highly efficient heat transfer to the external medium 19. Carbon nanotubes can also be fabricated into closely spaced structures for efficient convective heat transfer. The efficiency of the heat-exchange system 10 also allows for lower loading requirements for the external medium. Accordingly, the heat-exchange system 10 of the present invention is compact and light-weight in design. When used with cooling systems for automobiles, the heat-exchange system 10 of the present invention reduces fuel consumption, lowers emissions, and increases overall vehicle performance. In addition carbon nanotubes also have a very high elastic modulus (~1 terra Pascal (TPa)), and can endure high critical strains (~5%) before yielding, making the heat-exchange system 10 structurally sound and suitable for large-scale, commercial use. The invention can also be adapted for use with fuel cells to cool one or more components of the fuel cell directly (e.g., heat-exchange system 210 in FIG. 4).

Having briefly described an embodiment of a carbon nanotube heat-exchange system, as well as some of the more significant advantages associated therewith, various embodiments of the present invention will now be described in greater detail below.

The heat-exchange system 10 may be used with any suitable cooling system, such as the cooling system 12 shown in FIG. 1. For example, the heat-exchange system 10 may be used with cooling systems for use with internal combustion engines, bio-fuel processing, petroleum refining, industrial processing, and solar-thermal systems, to name only a few. Generally, the cooling system 12 has a coolant loop 16 that is in thermal contact with a heat source 14 (e.g., an internal combustion engine). One or more pumps 22 may be provided to circulate a cooling fluid through the coolant loop 16, as illustrated by arrows 20, 21. Note that the cooling fluid will be referred to hereinafter as cooling fluid 20. The cooling fluid 20 absorbs heat from the heat source 14 (illustrated by lines 18) as it circulates in thermal contact with heat source 14. The cooling fluid 20 is then delivered through the coolant loop 16 to heat-exchange system 10. The heat-exchange system 10 transfers heat from the cooling fluid 20 to an external medium (e.g., air from the ambient environment). Operation of the heat-exchange system 10 will be explained in more detail below. The cooling fluid 20 may then be recirculated through the coolant loop 16 to absorb more heat from the heat source 14. Alternatively, the cooling fluid 20 may be discharged from the coolant loop 16, collected for further processing, or otherwise removed from the coolant loop 16.

The coolant loop 16 may provide a flow path for the cooling fluid 20 via any suitable conduits, such as rubber hoses, metal pipes, or PVC pipes, etc. Preferably, the conduits are made from, or coated with a corrosion-resistant material. In addition, the coolant loop 16 is preferably sealed so that it does not leak cooling fluid 20.

The cooling fluid 20 that is circulated through the coolant loop 16 may be any suitable liquid (e.g., water, antifreeze, etc.) or gas (e.g., air), and the external medium (illustrated by arrows 19) is preferably an ambient medium (e.g., the surrounding air, water, etc.). Of course, the heat-exchange system 10 is not limited to use with any particular cooling fluid 20 or external medium 19. Any suitable cooling fluid 20, or two-phase fluid, and external medium 19 may be used according to the teachings of the present invention and state-of-the art understandings in heat-transfer science, as will become apparent to one skilled in the art after having become familiar with the teachings of the invention.

It should also be noted that the above description of the cooling system 12 shown in FIG. 1 is provided only as an illustration of one environment in which the heat-exchange system 10 of the present invention may be used. The heat-exchange system 10, however, may be used in conjunction with any suitable cooling system, now known or that may later be developed. Furthermore, cooling systems, such as the one shown in FIG. 1, and modifications thereto are well-understood in the art of heat-transfer science. Accordingly, the cooling system 12 will not be described in further detail herein.

The heat exchange system 10 that may be used with cooling system 12 to dissipate heat into the ambient environment according to one embodiment of the invention may comprise a distribution manifold 30 fluidically connecting the coolant loop 16 to a microchannel structure 24. Cooling fluid 20 circulating through the coolant loop 16 flows into the inlet end 30. In one embodiment, the inlet end 30 comprises a distribution manifold that disperses cooling fluid 20 among at least one microchannel 28 formed within the microchannel structure 24. A portion 11 of the heat exchange system 10 is shown in more detail in FIG. 2 according to one embodiment of the invention. Flow distribution among the microchannels 28 is illustrated by arrows 23.

The distribution manifold serves to disperse the cooling fluid 20 from the relatively large coolant loop 16 (e.g., 5 to 10 centimeters (cm) in diameter) into the relatively small microchannels 28 (e.g., 1 micron (μm) to 1 millimeter (mm)). Preferably, the distribution manifold is provided above or over the microchannel structure 24 so that the cooling fluid 20 flows in a downward direction into the microchannels 28. Such an embodiment tends to more evenly disperse the cooling fluid 20 from the coolant loop 16 into each of the microchannels 28. However, it is understood that other embodiments are also contemplated as being within the scope of the invention, and indeed, other configurations are also possible wherein the inlet end 30 is provided next to or even under the microchannel structure 24. Likewise, the cooling fluid 20 may be pumped, pressurized, or simply flow by gravity.

The microchannel structure 24 may comprise one or more flow paths 28 fluidically connecting the inlet end 30 to the outlet end 32 of the microchannel structure 24. The cooling fluid 20 from the flow path 28 is discharged from the heat-exchange system 10 on the outlet end 32. In one embodiment, the outlet end 32 comprises a discharge manifold. The discharge manifold serves to collect the cooling fluid 20 (e.g., for return back into the cooling loop 16).

In one embodiment, the flow path(s) 28 in the microchannel structure 24 may be characterized as being generally cylindrical in shape and cross-section and as having diameters that range from about 1 micron (μm) to about 1 millimeter (mm). Such a design provides thin thermal boundary layers having relatively high heat transfer coefficients, especially when compared to the heat transfer coefficients typical for larger, macro-scale flow paths. The higher heat transfer coefficients combined with an inherently large surface area provided by the flow paths 28 for contact with the cooling fluid 20 serve to increase the heat transfer capability of the microchannel structure 24.

For purposes of illustration, the section of microchannel structure 24 is shown in FIG. 2 having six independent flow paths 28 fluidically connecting the inlet end 30 to the outlet end 32. However, it is understood that the microchannel structure 24 may be fabricated with any suitable number of flow paths 28. For example, in another embodiment the microchannel structure 24 may comprise a single flow path 28 formed therethrough. It is also understood that the flow paths 28 are not limited to any particular geometry or size. Modifications can be made to the microchannel structure 24 (and to flow paths 28 defined therein) based on any number of design considerations, such as will become readily apparent to one skilled in the art of heat transfer science after having become familiar with the teachings of the invention. Illustrative, but not exhaustive, of such design considerations are the volume of cooling fluid 20 provided to the microchannel structure 24, the thermal conductivity of the material from which the microchannel structure 24 is fabricated, properties of the cooling fluid 20 (e.g., density, viscosity, heat transfer coefficient, Prandtl number, etc.), and the amount of heat that is to be removed from the cooling fluid 20.

In addition, the microchannel structure 24 may be a heat pipe. According to such an embodiment, the carbon nanotube structure 26 may comprise either carbon nanotubes "grown" directly on the heat pipe itself, or a polymer "superstructure" that is mounted thereto. Such embodiments will be described in more detail below with respect to the carbon nanotube structure 26. In any event, the carbon nanotubes may be arranged in any suitable manner on the heat pipe (e.g., on the evaporative portion, the transport portion, or the condensing portion).

The microchannel structure 24 may be fabricated using any of a variety of well-known manufacturing techniques. For example, the microchannel structure 24 may be extruded or injection molded. Still other manufacturing techniques, now known or that may be later developed, can also be used to fabricate the microchannel structure 24.

Generally, the microchannel structure 24 may be fabricated from any suitable material. According to one embodiment, the microchannel structure 24 may be fabricated from metal (e.g., aluminum, copper), or metal alloys. However, other embodiments are also contemplated as being within the scope of the invention. For example, the microchannel structure 24 may be fabricated from plastic or ceramic. Yet other embodiments are also contemplated as being within the scope of the invention.

In another preferred embodiment, the microchannel structure 24, or portions thereof, may be fabricated from carbon nanotubes. Microchannel structures 24 fabricated from carbon nanotubes may reduce oxidation and fouling that may occur when the microchannel structure 24 is fabricated from metal, and may therefore enhance the heat-transfer characteristics of the microchannel structure 24. In one such embodiment, single-walled carbon nanotubes (SWNTs) may be suspended in a polymer binder to form a SWNT-polymer composite. Production of SWNT-polymer composites is explained in more detail below with respect to the carbon nanotube structure 26. The SWNT-polymer composite may then be injection molded or extruded to fabricate the microchannel structure 24, or portions thereof.

The heat-exchange system 10 is also shown in FIG. 2 comprising carbon nanotube structure 26 arranged in thermal contact with the microchannel structure 24. The carbon nanotube structure 26 is preferably fabricated from single-wall carbon nanotubes (SWNTs). However, it is to be understood that in other embodiments the carbon nanotube structure 26 may be fabricated from multi-wall carbon nanotubes. The type of nanotubes used may depend on design considerations, such as the desired heat-transfer properties, cost of manufacture, among others.

For example, other design considerations include the so-called "percolation threshold". That is, objects which are homogeneously loaded into a matrix come into contact with one another as the density of the objects in the matrix increases. The percolation threshold is defined as the loading density where the objects are interconnected to form a continuous pathway through the matrix. The density of objects required to reach the percolation threshold will depend on the size and shape of the objects as well as their tendency to agglomerate. Objects that are long and thin are more likely to reach this percolation threshold at relatively low loading levels.

Both multi- and single-walled carbon nanotubes are long and narrow and the ratio of their length to width is typically in excess of a factor of $10^2$ and has been shown to exceed $10^7$. Thus, the percolation threshold for these materials tend to be much lower than, for example, carbon black loading. The thermal conduction characteristics of any nanotube composite are expected to be superior above the percolation threshold, and it is desirable that this threshold be reached with the minimum amount of high thermal conductivity material.

SWNTs can basically be described as nano-scale cylinders of graphite. A TEM image of raw, as-produced SWNT material is shown in FIG. 3(*a*). The diameters and atomic arrangements of the SWNTs are dictated by the geometric constraints that limit how a two-dimensional graphene lattice can be rolled to form a seamless tube. Individual SWNTs may have a diameter in the range of about 1 to 2 nanometers (nm) and a wall thickness of about 1 atomic carbon layer. The single atomic carbon layer folds over into the shape of a long cylinder, thereby forming an individual SWNT.

Two limiting SWNT structures are defined by the circumference being comprised of sp2 bonded carbon atoms in either an "arm-chair" or a "zig-zag" configuration. Different types of arm-chair and zig-zag configurations with different diameters are also possible, as are configurations between these two limits having other helicities. The so-called (10,10) arm-chair tube has a non-zero density of states at the Fermi energy and therefore has properties of a metal. The (17,0) zig-zag tube is a true semiconductor with an energy gap. Calculating the density of states for arm-chair tubes as a function of tube diameter shows that each spike in the density of states is associated with an $E^{-1/2}$ singularity characteristic of the dispersion in a one-dimensional electron conductor. These materials have a theoretical thermal conductivity as high as 6000 W/m-K. The diameters and helicities of the SWNT material can be controlled through synthesis.

In addition to the high thermal conductivity of SWNTs, SWNTs also have a demonstrated elastic modulus on the order of 1 TPa and can sustain critical strains of 5% before yielding. In addition, SWNTs are a relatively light-weight material. The high strength and small mass of SWNTs creates mechanical resonant frequencies of 100 megahertz (MHz) to 10 gigahertz (GHz). Accordingly, the carbon nanotube structure 24 is well-suited for use with embodiments of heat-exchange system 10 of the present invention.

Carbon nanotube material may be generated by any of a number of processes for use with the heat-exchange system 10 of the present invention. For example, carbon nanotube material may be generated using laser-based synthesis, growth by chemical vapor deposition (CVD) on metal particles, solar furnace evaporation, and hot-wire deposition. Use of particular methods for generating carbon nanotube material is a matter of a design choice. Design considerations may include, but are not limited to, cost, production quantities, types of nanotubes, interface bonding characteristics, heat-exchange system configurations, and the desired purity of the carbon nanotubes.

During production of the carbon nanotube material, metal particles, graphite, and/or amorphous carbon may be formed along with the carbon nanotube product from the raw carbon soot used to generate the carbon nanotubes. Non-nanotube particulate matter provide sites for the agglomeration of nanotubes, minimizing their effective homogenous distribution in polymer solutions. Accordingly, it may be desirable to purify the carbon nanotubes before using them to fabricate the carbon nanotube structure 26 for the heat-exchange system 10. Any of a variety of purification methods may be used that have been developed for removing metal particles, graphite, and/or amorphous carbon from the carbon nanotube product. A TEM image of 98 wt % pure SWNTs is shown in FIG. 3(*b*).

The carbon nanotube structure 26 may be fabricated from the carbon nanotube material according to any suitable method now known or later developed. For example, the carbon nanotube material may be suspended in a polymer binder. Techniques have been developed for combining carbon nanotubes into a series of non-ionomeric polymers including polyethylene, poly-methyl methacralate (PMMA), polypropylene, polyacroylonitrile (PAN), polytetraflouroethylene (PTFE). Conductive polymers may also be used to enhance the thermal characteristics of the nanotube-polymer composite. The carbon nanotube structure 26 may then be fabricated from the suspended nanotube-polymer composite using any suitable method, such as but not limited to, extrusion techniques or injection molding.

The following describes an example of one technique that has been used to generate a SWNT-polymer composite. First, the SWNT material was blended into an ethanol/water solution that contained 5% weight for weight (w/w) of a perfluoro-polyester sulfonic acid ionomer (e.g., Nafion (EW=1100)) and a 5 to 40% w/w aqueous polyester sulfonic acid ionomer (e.g., Eastman AQ (EW=1000)). SWNT material was placed in the solution and mechanically blended for about 72 hours at about 25° C. The solution was then centrifuged for 30 minutes at about 10,000 revolutions per minute (rpm). The resulting supernatant was a homogenous solution of SWNTs and ionomer.

The solution of SWNTs and ionomer was then solution cast as a membrane on a Teflon-coated aluminum template at 30° C., and formed a membrane of SWNT-polymer composite. The membranes were dried in vacuo for about 1 hour at about 80° C. to remove solvents and anneal the SWNT-polymer composite above the glass transition temperature ($T_g$) of the ionomer. The resultant films were then stored in a desiccator under argon. A TEM image of a SWNT-polymer composite membrane produced according to the example just described is shown in FIG. 3(*c*).

The SWNT-polymer composite membranes may be evaluated using a variety of spectroscopic, thermal, and mechanical analyses. For example, four point direct current (DC) resistivity measurements showed that the resistivity of an initial dry Nafion polymer is reduced to 200 Ohm-cm with just 0.1% w/w loading of SWNTs. It is noted that good electrical conductivity is a strong indicator of good thermal conductivity. As another example, differential scanning calorimetry studies of a 1% w/w SWNT doped sample showed an increase in the glass transition of Nafion polymer of about 20° C. at a heating rate of 10° C./min. Thermal gravimetric analysis (TGA) of the air oxidation of the Nafion polymer showed an increase to the onset of decomposition by 12° C. for the 1% SWNT-doped sample. These results indicate significant thermal and electronic properties of SWNT-polymer composites, even those having very low concentrations of SWNT material. Of course other analyses are also possible to characterize the heat-exchange properties of the SWNT-polymer composites, such as but not limited to, Raman spectroscopy, and UV-VIS-NIR spectroscopy to establish type and orientation of nanotubes in the matrix.

Yet other properties of the SWNT-polymer composite may be controlled during synthesis to produce SWNT-polymer composites having different thermal and mechanical properties. For example, the directional alignment of the SWNTs within the polymer matrix may be controlled to produce bundled or aligned SWNT-polymer composites (see FIG. 3(*d*)). One such technique for aligning SWNTs includes the use of electrical fields (electrophoresis) during extrusion or polymer casting of the SWNT material with polymeric substrates, such as polyethylene or PTFE. During such synthesis, the SWNTs align within the electrical field. Other methods for producing different thermal properties include attaching nanotubes having various functional groups to other polymer systems and then co-extruding them into a single fibrous co-polymer. The heat transfer characteristics of the SWNT-polymer composite may also be enhanced by changing the density of the SWNT material, and the type of polymer material that is used, among other techniques.

The SWNT-polymer composite may be fabricated as one or more "fin-like" structures to form a SWNT-polymer superstructure (i.e., carbon nanotube structure 26). In an exemplary embodiment, these fin-like structures may each be about one-quarter to about three-eighths inch tall and about one inch wide. Of course other embodiments are also contemplated as being within the scope of the invention, and the particular dimensions of the fin-like structures will depend at least to some extent on various design considerations. In any event, the carbon nanotube structure 26 is arranged in thermal contact with the microchannel structure 24.

Figure 4:
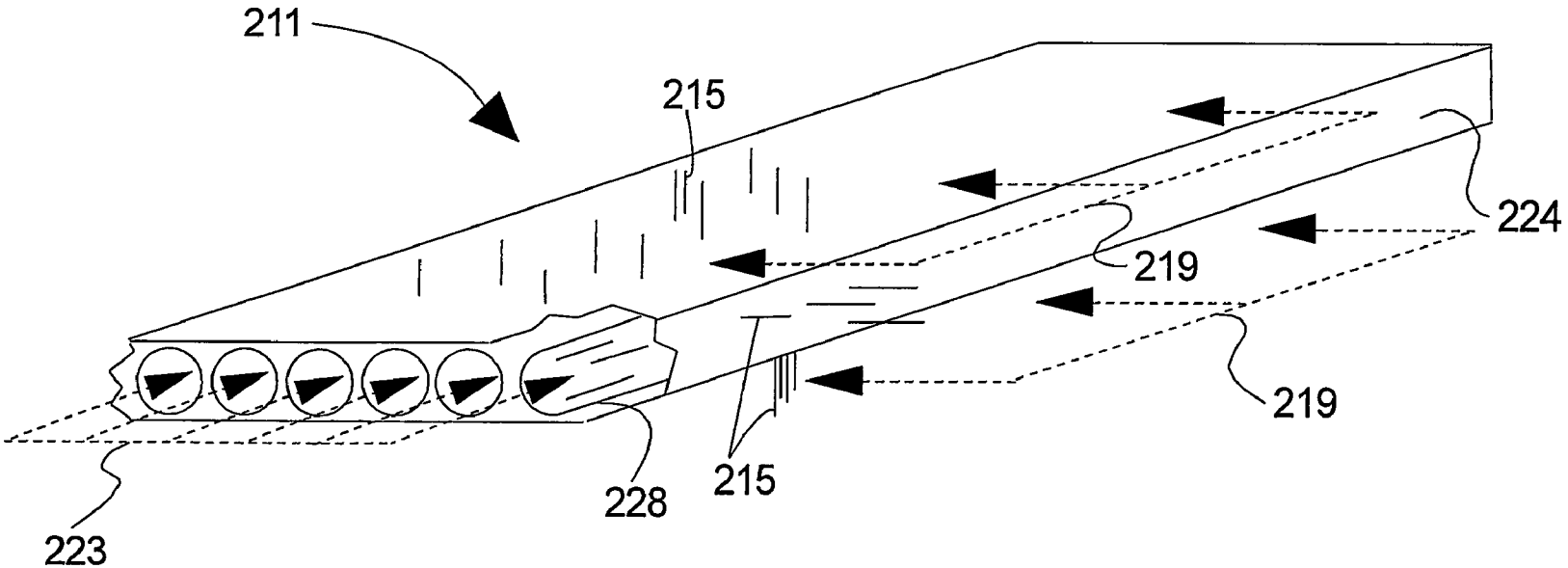
FIG. 4 shows a detailed section of another embodiment of a heat-exchange system wherein the carbon nanotube structure comprises carbon nanotubes grown directly on the microchannel structure.

According to one embodiment, the SWNT-polymer superstructure (i.e., carbon nanotube structure 26) may be bonded directly to the microchannel structure 24. Techniques for attaching the carbon nanotube structure 26 to the microchannel structure 24 include, for purposes of illustration, metallurgical bonding (e.g., where the microchannel structure 24 is made from a metal), use of a commercially available binder material (e.g., a metal or polymer binder), sintering, hot press, and electrochemical bonding techniques, to name a few. Alternatively, the carbon nanotube structure 26 may comprise carbon nanotubes "grown" directly on the microchannel structure 24, for example, using chemical vaporization deposition (CVD) techniques. Such an embodiment is shown in FIG. 4, wherein two-hundred series reference numbers are used to identify like-elements (e.g., microchannel structure 224). In yet another embodiment, the microchannel structure 24 may comprise corrugations upon which the carbon nanotubes are "grown" thereon.

It is noted that the carbon nanotube structure 26 is not limited to having the fin-like structures that are shown in FIG. 2. The carbon nanotube structure 26 may be any suitable shape (e.g., rectangular, cylindrical, trapezoidal, etc.) and may be arranged on the microchannel structure 24 in any suitable manner. The particular configuration may depend at least to some extent on various design considerations, such as the cross-sectional area, pressure drop requirements, and heat-transfer requirements.

According to one embodiment, the carbon nanotube structure 26 is impermeable to the external medium 19. That is, the external medium flows around and between the carbon nanotube structure 26, as illustrated by arrows 19 in FIG. 2, but not through the SWNT-polymer composite. Heat that has been transferred from the cooling fluid 20 to the SWNT-polymer composite is transferred from the carbon nanotube structure 26 to the external medium 19. In addition, the flow around the fin-like structures may cause the carbon nanotube structure 26 to vibrate. Vibration during use disrupts the boundary layer, causing the boundary layer to remain thin, and increasing the heat-transfer characteristics of the carbon nanotube structure 26.

Figure 5:
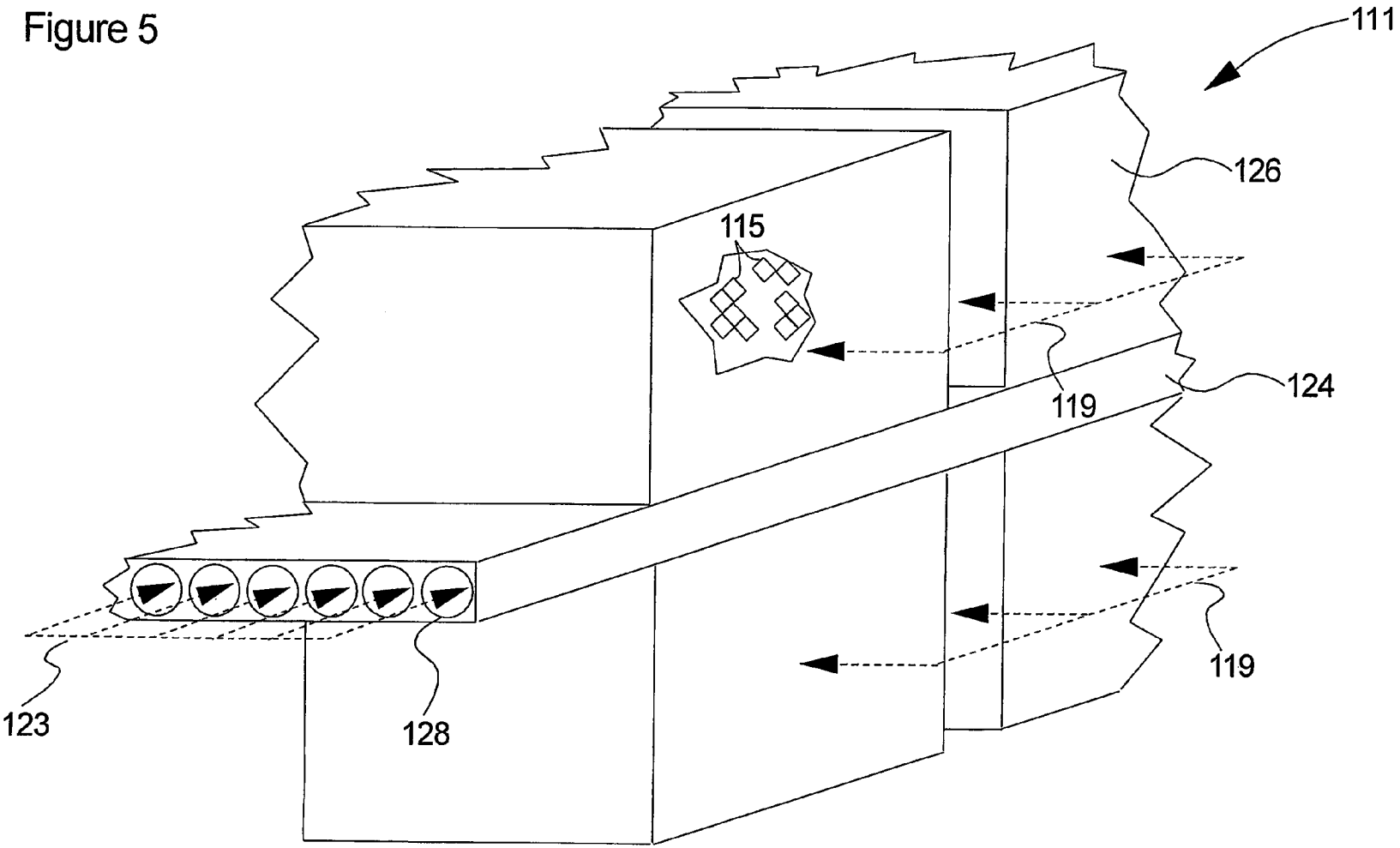
FIG. 5 shows a detailed section of another embodiment of a heat-exchange system wherein the carbon nanotube structure is an open-cell porous media.

A portion 111 of another embodiment of the heat-exchange system 10 is shown in FIG. 5. Again, carbon nanotube structure 126 is arranged in thermal contact with microchannel structure 124. The cooling fluid 20 is dispersed by the distribution manifold 30 (FIG. 1) among the microchannels 128 formed in the microchannel structure 124, as illustrated by arrows 123 in FIG. 5. In this embodiment, however, the carbon nanotube structure 126 may be fabricated as an open-cell, porous media structure that the external medium 19 can readily permeate, as illustrated by arrows 119 in FIG. 5.

In one such embodiment, the open-cell, porous media structure 126 may be fabricated by forming the carbon nanotubes into a matrix or structure that surround voids (see FIG. 5). For example, the carbon nanotubes may be formed into triangles, squares, pentagons, hexagons, octagons, dodecahedrons, etc. to form a superstructure of carbon nanotubes (i.e., carbon nanotube structure 126), or even a structure of randomly interconnected pores (e.g., carbon nanotubes 115 in FIG. 5). Such structures may be formed by shaping the polymer or the carbon nanotubes in another binder material, or even pressing the carbon nanotube material into such formations without using a binder material.

Again with reference to FIG. 5, the external medium 19 flows through the open pores in the carbon nanotube structure 126 and absorbs and dissipates thermal energy released from the cooling liquid 20 flowing through the microchannel structure 124. This embodiment allows the porous media to be tailored (e.g., by sizing the open-cell diameters) to maximize thermal convection heat transfer within the porous media.

As discussed above, the heat-exchange system 10 may be used in automobile cooling systems (e.g., cooling system 12). The heat-exchange system 10 exhibits unique thermal exchange properties that allow it to be produced with a compact design. In addition, the frontal flow area for the external medium 19 may be decreased. These design advantages serve to improve the automobile's performance, and to reduce fuel consumption and emissions by reducing overall weight and aerodynamic drag. Indeed, in some applications, the heat-exchange system 10 may even be provided on the side(s) of the vehicle rather than in front of the automobile, further decreasing aerodynamic drag.

It should be noted that the heat-exchange system 10 of the present invention can be used in any of a variety of applications, and is not limited to use with internal combustion engines. For example, the heat-exchange system of the present invention can also be used with fuel cells. Fuel cells convert hydrogen and oxygen into electricity and heat. The electricity can be used to power motors (e.g., for vehicles), lights, or various stationary and portable electrical appliances (e.g., PCs). One embodiment of the heat-exchange system 210 is described herein and shown in FIG. 6 as it can be used with a proton exchange membrane (PEM) fuel cell. Of course the heat-exchange system can be used with any of a variety of other fuel cell types and is not limited to use with PEM fuel cells. Likewise, the heat-exchange system can be used with other components of the fuel cell.

Briefly, the PEM fuel cell may comprise an anode catalyst 50 (i.e., the negative terminal), a cathode catalyst 52 (i.e., the positive terminal), and a membrane 54. Hydrogen gas is supplied to the fuel cell through channel 56, as illustrated by arrow 58. When a hydrogen molecule comes into contact with the anode catalyst 50, the hydrogen molecule splits and forms two positively charged hydrogen ions and two electrons. The electrons are conducted by the anode catalyst 50 and can then be used in an electrical circuit (e.g., to power a motor or other electrical device). Oxygen gas (e.g., in the form of air) is also supplied to the fuel cell through the channel 60, as illustrated by arrow 62, where it forms two oxygen atoms. Each of the oxygen atoms provides a negative charge that attracts the two hydrogen ions. The membrane 54 conducts positively charged ions (i.e., the hydrogen ions) and blocks electrons. Thus, the hydrogen ions are conducted through the membrane 54 where they recombine to form water.

Thermal energy is generated during this process for the most part at the fuel cell electrode. Hydrogen is not necessarily distributed evenly through the channel 56 in conventional fuel cells. For example, concentrations are generally higher at the inlet end. In addition, the channel 56 is generally rectangular-shaped to maximize hydrogen flow. However, this design may cause a pressure drop in the channel 56 and/or mixing of the reacted hydrogen and unreacted hydrogen. Thus, the unreacted hydrogen concentration may be higher or lower in different areas of the channel 56. Such uneven distribution of hydrogen may cause "hot spots" to form at various positions along the channel 56.

Figure 6:
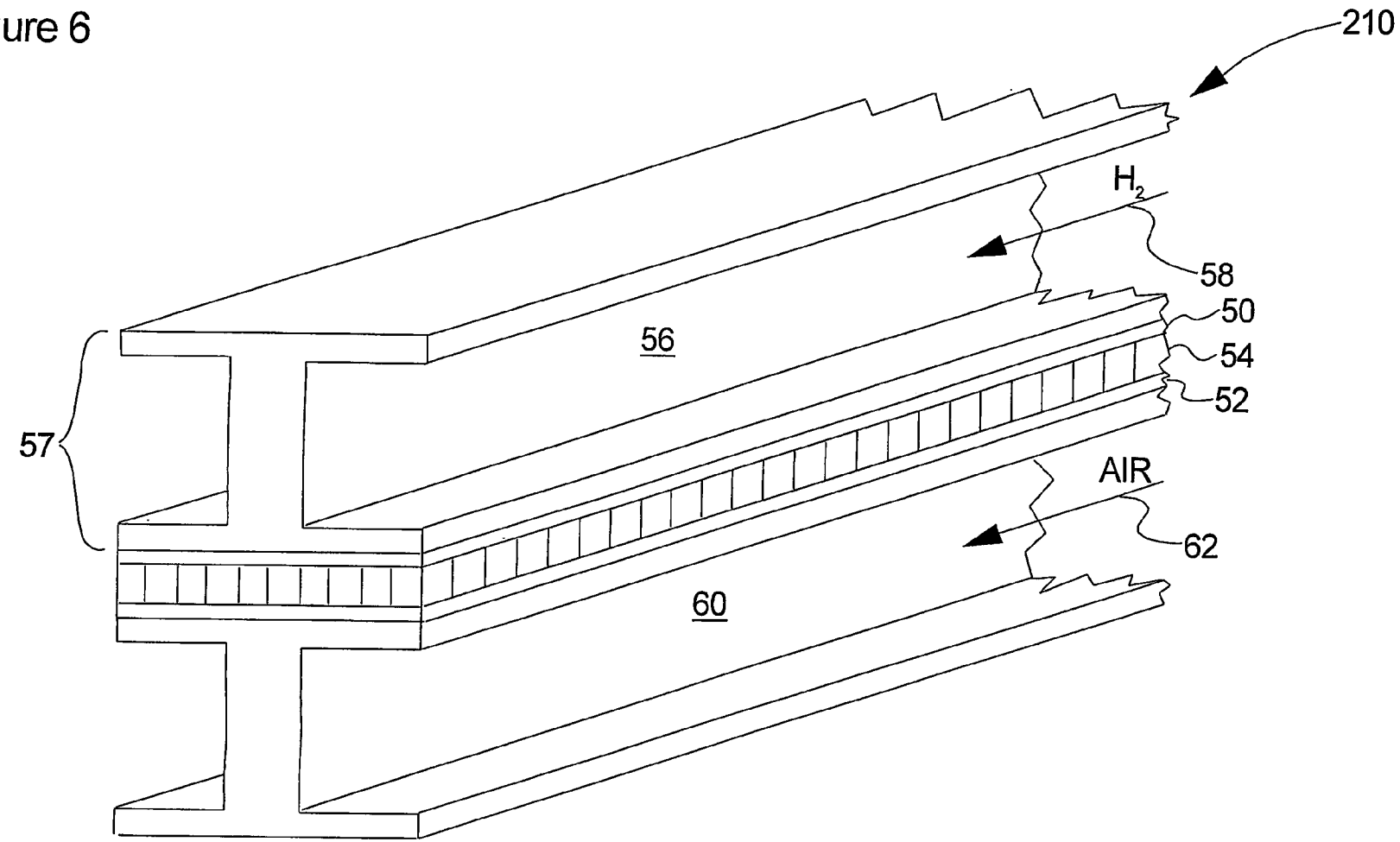
FIG. 6 shows a detailed section of another embodiment of a heat-exchange system for use with a fuel cell.

According to one embodiment of the invention, a thermal management layer 57 may be integrated directly into one or more components of the fuel cell or channel 56. In one such embodiment, the thermal management layer 57 may be fabricated from a carbon nanotube-based material, such as the SWNT-polymer composite described above. The thermal management layer 57 may be a channel, as shown in FIG. 6, or the thermal management layer 57 may be formed without a channel.

The carbon nanotube material serves as a high-conductivity path to dissipate heat that may be generated and reduce or altogether eliminate the occurrence of hot spots. The SWNT material is also advantageous in that it serves to store hydrogen. Because at least some of the hydrogen is supplied from the thermal management layer itself, where a channel 56 is provided, it may be made smaller and/or of different geometries to improve flow characteristics of the hydrogen gas, and in turn, reduce heat generated by the fuel cell. In yet other embodiments, the SWNT material may be charged with hydrogen prior to operation of the fuel cell. Such an embodiment may serve to reduce electrode and transport losses by the elimination of diffusion layers.

Of course it is understood that the heat-exchange system 10 may also be used in any of a variety of other applications. For example, the heat-exchange system 10 may be used in various electronic applications, such as but not limited to personal computers (PCs). In such an embodiment, the thermal management layer may be fabricated as a "tape" positioned in direct contact with the heat source so that it wicks heat away from the heat source. Indeed, the thermal management layer may even be channeled or routed around heat-sensitive components or entire areas, similarly to routing wires on thin-film transistors. In other applications, the carbon nanotube structure 26 may also be selectively arranged, such as on the condenser portion or the evaporator portion of a heat pipe.

It is readily apparent that the carbon nanotube heat-exchange system 10 according to embodiments of the invention exhibits unique thermal exchange properties. The relatively low weight, small frontal flow area for the external medium, and relatively high heat-exchange capacity make the heat-exchange system 10 particularly advantageous as an alternative to conventional heat-exchange systems, especially for use in automobile cooling systems. Consequently, the claimed invention represents an important development in the field of heat-exchange systems.

Having herein set forth preferred embodiments of the present invention, it is anticipated that suitable modifications can be made thereto which will nonetheless remain within the scope of the present invention. Therefore, it is intended that the appended claims be construed to include alternative embodiments of the invention except insofar as limited by the prior art.

The invention claimed is:

1. A carbon nanotube heat-exchange system, comprising:

a microchannel structure having an inlet end and an outlet end, the inlet end providing a cooling fluid into said microchannel structure and the outlet end discharging the cooling fluid from said microchannel structure;

at least one flow path defined in said microchannel structure, said at least one flow path fluidically connecting the inlet end to the outlet end of said microchannel structure; and a carbon nanotube structure provided in thermal contact with said microchannel structure, said carbon nanotube structure receiving heat from the cooling fluid in said microchannel structure and dissipating the heat into an external medium that is external to the carbon nanotube heat-exchange system.

2. The carbon nanotube heat-exchange system of claim 1, wherein the inlet end comprises a distribution manifold.

3. The carbon nanotube heat-exchange system of claim 1, wherein the outlet end comprises a discharge manifold.

4. The carbon nanotube heat-exchange system of claim 1, wherein said carbon nanotube structure comprises carbon nanotubes grown directly on said microchannel structure.

5. The carbon nanotube heat-exchange system of claim 1, wherein said carbon nanotube structure is fabricated from single-wall carbon nanotubes (SWNTs).

6. The carbon nanotube heat-exchange system of claim 1, wherein said carbon nanotube structure is fabricated from multi-wall carbon nanotubes.

7. The carbon nanotube heat-exchange system of claim 1, wherein said carbon nanotube structure is fabricated from a SWNT-polymer composite.

8. The carbon nanotube heat-exchange system of claim 1, wherein said carbon nanotube structure is impermeable to the external medium.

9. The carbon nanotube heat-exchange system of claim 1, wherein said carbon nanotube structure is an open-cell porous media.

10. The carbon nanotube heat-exchange system of claim 1, wherein the carbon nanotube structure comprises nanotubes bundled to form superstructures surrounding a void space, said nanotubes bundles as triangles, squares, pentagons, hexagons, octagons, dodecahedrons.

11. The carbon nanotube heat-exchange system of claim 1, wherein the microchannel structure is fabricated at least in part from metal.

12. The carbon nanotube heat-exchange system of claim 1, wherein the microchannel structure is fabricated at least in part from carbon nanotubes.

13. A carbon nanotube heat-exchange system, comprising a thermal management layer fabricated from carbon nanotubes, said thermal management layer dissipating heat into an external medium.

14. The carbon nanotube heat-exchange system of claim 13, wherein said thermal management layer stores hydrogen for release during operation of a fuel cell.

15. The carbon nanotube heat-exchange system of claim 13, wherein said thermal management layer is routed away from heat-sensitive areas.

16. The carbon nanotube heat-exchange system of claim 13, wherein said thermal management layer is in direct contact with a source of the heat.

17. A carbon nanotube heat-exchange system, comprising first means for transferring heat and dissipating the heat into an external medium, said first means for transferring including carbon nanotubes;

means for providing a cooling fluid through said first means for transferring, said means for providing being an inlet;

means for discharging the cooling fluid from the first means for transferring, said means for discharging being an outlet; and second means for transferring the heat from the cooling fluid to said first means for transferring, said second means for transferring including a carbon nanotube microchannel.

18. A method for using a carbon nanotube heat-exchange system, comprising: receiving a cooling fluid through a carbon nanotube microchannel structure; absorbing heat in the cooling fluid; transferring heat from the cooling fluid in the carbon nanotube microchannel structure to another carbon nanotube structure; and dissipating the heat from the other carbon nanotube structure into an external medium.

19. A method for producing a carbon nanotube heat-exchange system, comprising: fabricating a carbon nanotube microchannel for receiving a cooling fluid; fabricating a carbon nanotube structure; and arranging the carbon nanotube microchannel in thermal contact with the carbon nanotube structure.

20. The method of claim 19, wherein arranging the microchannel structure in thermal contact with the carbon nanotube structure comprises growing the carbon nanotube structure on the microchannel structure.

21. The carbon nanotube heat-exchange system of claim 19, further comprising arranging said carbon nanotube structure on said carbon nanotube microchannel to avoid heat-sensitive areas.

22. The carbon nanotube heat-exchange system of claim 19, further comprising controlling pore size of said carbon nanotube structure during fabrication thereof.

23. The carbon nanotube heat-exchange system of claim 19, further comprising aligning SWNTs in said carbon nanotube structure during fabrication of the carbon nanotube structure.

* * * * *